United States Patent [19]

Snyder

[11] 4,063,725

[45] Dec. 20, 1977

[54] FOLDABLE CUBE FORMING GEOMETRIC DEVICE

[76] Inventor: Thomas A. Snyder, 1143 Monroe St., Eugene, Oreg. 97402

[21] Appl. No.: 730,330

[22] Filed: Oct. 7, 1976

[51] Int. Cl.[2] ..... A63B 9/00

[52] U.S. Cl. ..... 272/113; 46/1 L

[58] Field of Search ..... 272/100, 113, 112; 35/72, 60, 34; 46/1 R, 1 L; 52/DIG. 10, 648

[56] References Cited

U.S. PATENT DOCUMENTS

| | | | |
|---|---|---|---|
| 1,997,022 | 4/1935 | Stalker | 46/1 L |
| 3,632,109 | 1/1972 | Dattner | 272/113 X |
| 3,659,360 | 5/1972 | Zeischegg | 46/17 X |
| 3,749,636 | 7/1973 | Tranquillitsky | 52/DIG. 10 |
| 3,899,838 | 8/1975 | Lalley et al. | 35/72 |

*Primary Examiner*—William H. Grieb
*Assistant Examiner*—William R. Browne
*Attorney, Agent, or Firm*—Kolisch, Hartwell, Dickinson & Stuart

[57] ABSTRACT

A changeable-configuration geometric device including four right tetrahedrons hinged together with an equilateral tetrahedron in such a manner that the various tetrahedrons may be swung relative to one another to form an infinite number of different overall configurations for the device. One configuration which is producible is that of an equilateral cube, in which configuration the equilateral tetrahedron forms the central core of the cube.

7 Claims, 9 Drawing Figures

FOLDABLE CUBE FORMING GEOMETRIC DEVICE

BACKGROUND AND SUMMARY OF THE INVENTION

This invention pertains to a changeable-configuration three-dimensional geometric device formed as an articulated structure including four right tetrahedrons and one equilateral tetrahedron. While, as will be explained, the proposed device has a number of possible different uses, one particular use, described herein, is as a piece of child's playground-type equipment.

Structures which are articulated, and whose configurations can be changed infinitely and at will, hold a great deal of interest for people, and especially for children. With such a device, the usual child's imagination can conceive of the device as embodying or representing a host of different kinds of exciting places and/or things.

A general object of the present invention is to provide an articulated device of the type generally outlined, which is visually exciting and pleasing, and is subject to manipulation into an infinite number of different, unique configurations.

According to a preferred embodiment of the invention, the proposed device includes four right tetrahedrons, along with a single equilateral tetrahedron. Hinges are provided that interconnect these five units into an articulated structure which can be adjusted into an infinite number of different configurations. In particular, the hinging arrangement is such that one of the configurations which is possible is that of an equilateral cube, wherein the equilateral tetrahedron forms what might be thought of as the central core of the cube.

The equilateral tetrahedron has four equilateral triangular faces, and each of the right tetrahedrons includes an equilateral triangular face of substantially the same size as each of the faces in the equilateral tetrahedron.

Other objects and advantages which are attained by the invention will become more fully apparent as the description which now follows is read in conjunction with the accompanying drawings.

DETAILED DESCRIPTION OF THE INVENTION

Figures 1, 2, 3, 4:
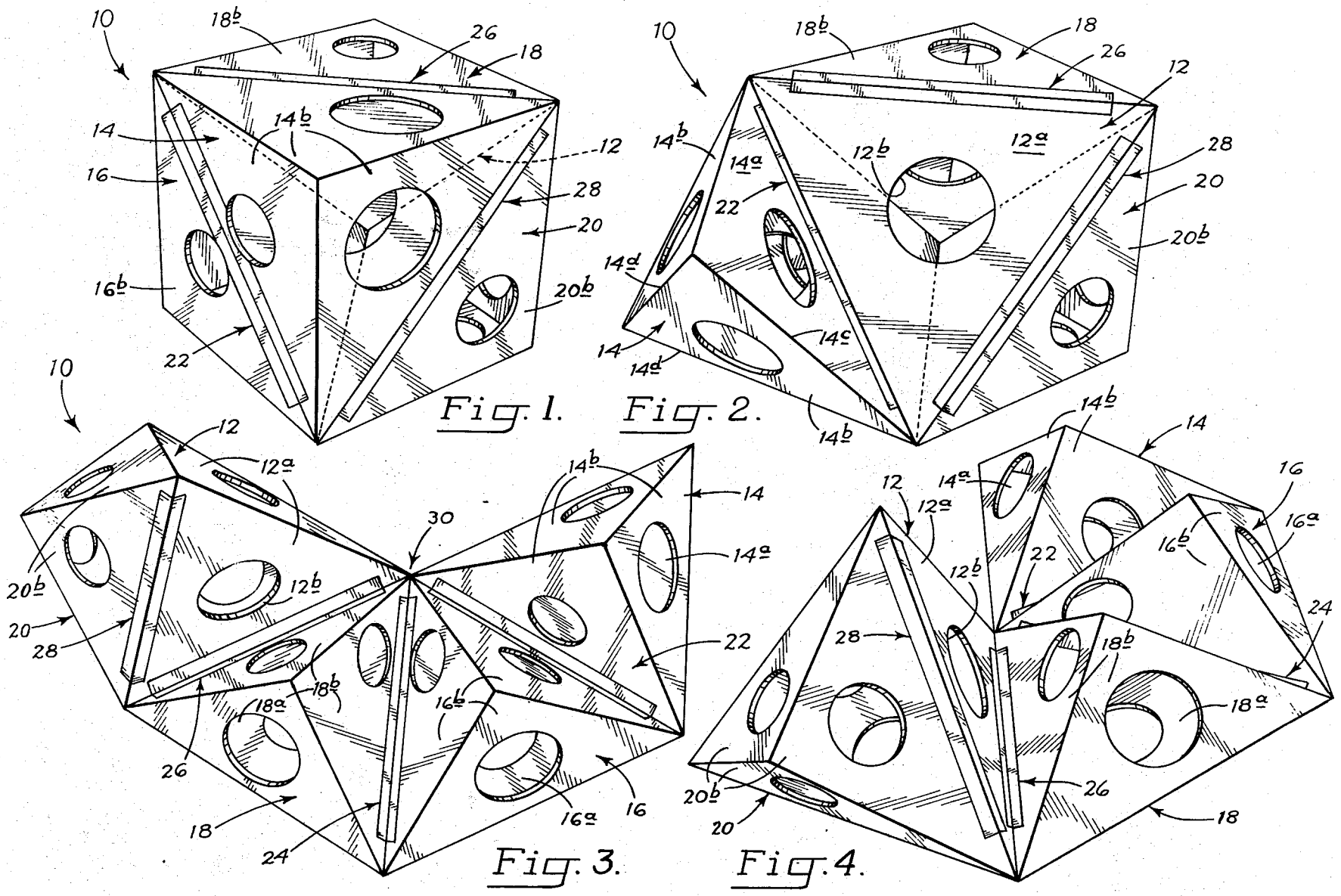
FIG. 1 is a top perspective view of an embodiment of a device constructed in accordance with the present invention, with the device shown in the form of an equilateral cube.
FIG. 2 is a view taken from the same point of view as FIG. 1, but showing one of the right tetrahedrons in the device located in a different position.
FIGS. 3–8, inclusive, are different perspective views, each taken from a different point of view, and each illustrating the device in a different one of the infinite number of configurations which its parts may assume.
Figure 6:
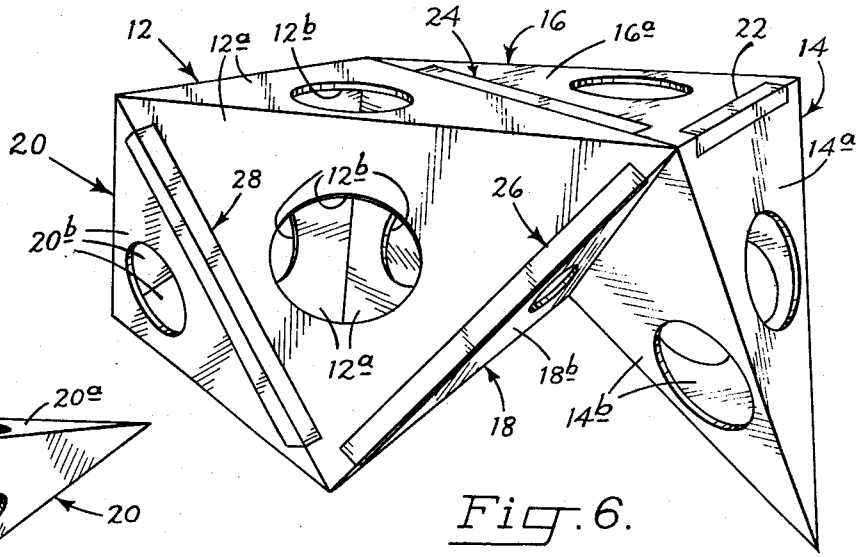
Figure 8:
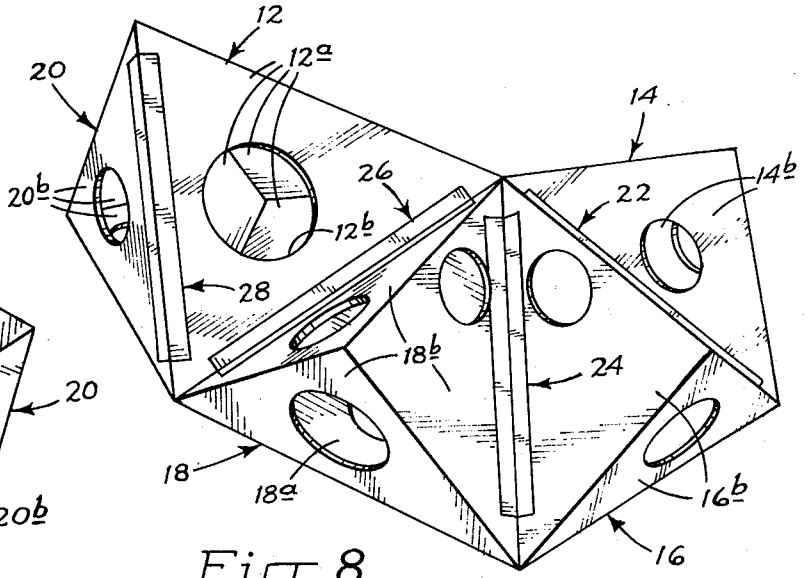

Turning now to the drawings, and referring to all of the drawing figures, indicated generally at 10 is an articulated, changeable-configuration geometric device constructed in accordance with the present invention. Device 10 comprises five hollow units including an equilateral tetrahedron 12, and four right tetrahedrons 14, 16, 18, 20.

Tetrahedron 12 is made up of four equilateral triangular panels, such as panel **12*a* (see particularly FIG. 2), which are suitably joined at their edges to form a rigid unit. While, as will become apparent, different specific materials and sizes may be used with respect to the units in device 10, device 10 herein has been designed for use as a piece of outdoor playground equipment for children. Accordingly, it is constructed using sturdy materials, and sized to permit easy crawling into and around of the units. For example, panels 12*a* are formed herein of thin plywood, with the edges of the panels each measuring about 1.4 meters. Inasmuch as device 10 is conceived herein as being a piece of playground equipment, the various units therein are provided with circular crawling holes, and in tetrahedron 12, circular holes, such as hole 12*b***, are provided in each of the four panels making up the tetrahedron.

Each of the right tetrahedrons is of substantially the same construction with respect to each other, and is similar in construction to tetrahedron 12. More particularly, and considering tetrahedron 14, it is made up of four edge-joined triangular panels including an equilateral triangular panel **14*a*, and three right-triangular panels, such as panel 14*b*. The dimensions of panel 14*a* are substantially exactly the same as the dimensions of previously mentioned panels 12*a*. Each of panels 14*b* includes a long edge, such as 14*c*, which has the same length as an edge in panel 14*a*, and a pair of right-angularly disposed shorter edges 14*d*, each of which has a length herein of about 1 meter. Panels 14*a*, 14*b* are formed of the same material as is used in panel 12*a*. Further, each of the four panels in tetrahedron 14** is provided with a circular hole, as can clearly be seen in the drawings.

Each of the other three right tetrahedrons, as has been mentioned, is similarly constructed and sized, with these three tetrahedrons including equilateral triangular panels shown at **16*a*, 18*a*, 20*a*, and right-triangular panels, such as those shown at 16*b*, 18*b*, 20*b*. Further, each of the four panels in these other three right tetrahedrons is similarly provided with circular holes, like those provided in the panels of tetrahedron 14**.

Also included in device 10 are hinges, or hinging means, which join the tetrahedrons into an articulated structure. These hinges, of which there are four, are shown at 22, 24, 26, 28. Hinge 22 joins one of the long edges in tetrahedron 14 with a similar edge in tetrahedron 16. Hinge 24 does the same with respect to a pair of long edges in tetrahedrons 16, 18. These two hinges are referred to herein as joining tetrahedrons 14, 16, 18 into a subassembly, with three corners of these three tetrahedrons, indicated generally at 30 in FIG. 3, disposed adjacent each other. Hinge 26 joins a long edge in tetrahedron 18 with one of the edges in tetrahedron 12, and hinge 28 joins a long edge in tetrahedron 20 to another edge in tetrahedron 12.

Figure 9:
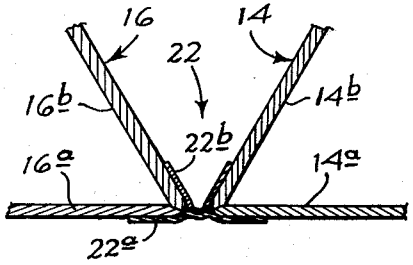
FIG. 9 is a fragmentary cross-sectional view, on an enlarged scale, showing a hinge construction which is used in the proposed device.

Considering for a moment the particular construction employed for the hinges herein, and before discussing the particular locations of the hinges, FIG. 9 shows an enlarged cross-sectional view of hinge 22. Here it is seen that hinge 22 takes the form of elongated flexible strips **22*a*, 22*b* which extend along the confronting adjacent edges in tetrahedrons 14, 16. These strips are suitably attached, as by gluing, to the margins of the outer faces of panels 14*a*, 16*a*, 14*b* 16*b***. Any suitable material, such as fabric-reinforced tape, may be used for the strips in a hinge. The other three hinges are similarly constructed.

Referring for a moment particularly to FIG. 3, for the purpose of explaining the particular arrangement of the hinge locations, it will be recalled that FIG. 3 is essentially a top plan view of device 10. In this configuration of the device, the equilateral triangular faces of panels 14*a*, 16*a*, 18*a* are coplanar, and lie substantially in the plane of FIG. 3. Also, the equilateral triangular face defined by that panel 12*a* in tetrahedron 12 which is away from the viewer in the figure also lies in the plane of the figure. It will thus be seen that hinges 22, 24, 26 lie adjacent the plane of the figure, while hinge 28 extends upwardly at an oblique angle to this plane. It will further be noted that hinge 28 joins tetrahedron 12, 20 in such a way that the equilateral triangular face in tetrahedron 20 can close upon (and is shown closed upon) that face in tetrahedron 12 which is opposite that corner in tetrahedron 12 which is adjacent the three corners indicated at 30.

Figure 5:
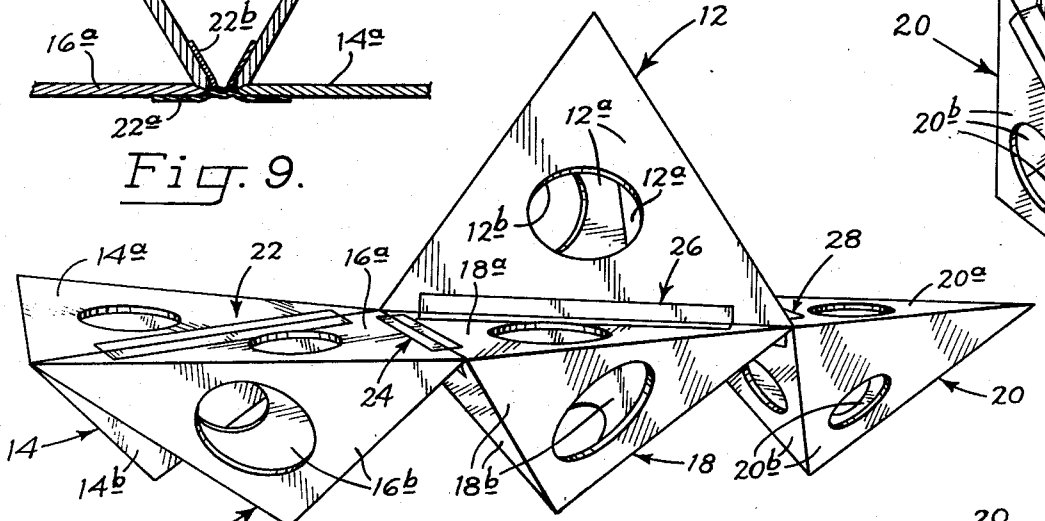
Figure 7:
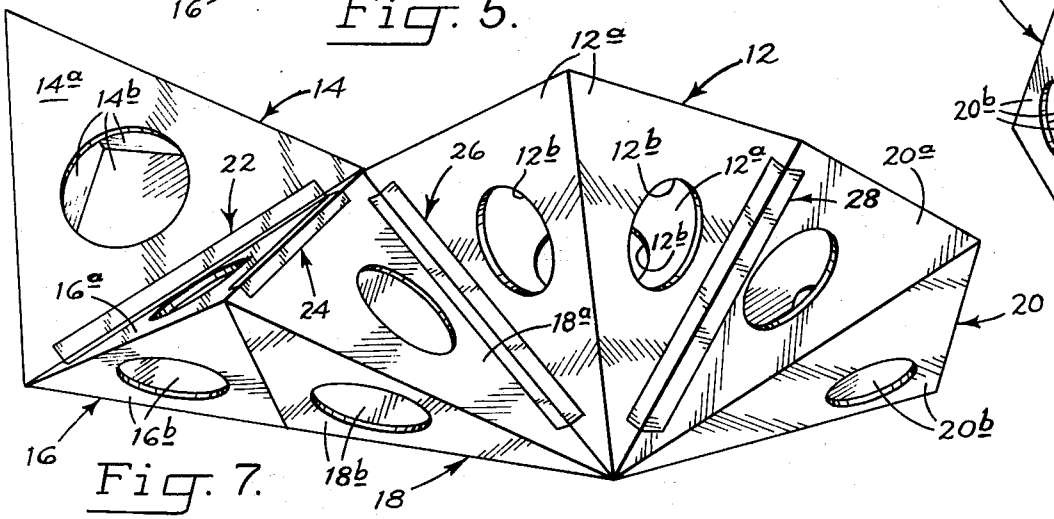

A further feature of the arrangement of the hinges and tetrahedrons is shown in FIG. 5, wherein it is seen that right tetrahedrons 14, 16, 18, 20 may be adjusted to positions with their equilateral faces, defined by panels 14*b*, 16*b*, 18*b*, 20*b*, lying in a plane common with one of the equilateral faces (concealed in figure) of equilateral tetrahedron 12, and with all of the the right tetrahedrons projecting in a common direction away from this common plane.

As has been mentioned, it is possible to adjust the relative positions of the tetrahedrons in device 10 to provide the device with an infinite number of different configurations. In the case of the specific device which is illustrated herein several of these positions, which children might select for use in a playground setting, have been illustrated in various ones of the drawing figures. The combination of the hollow tetrahedrons, and the circular access holes, provide interesting spaces and arrangements for children to crawl into and out of. One of the notable features of the invention is that it is possible to fold up the device so as to form an equilateral cube, such as is illustrated in FIG. 1, with equilateral tetrahedron 12, in essence, forming the central core of this cube.

It will thus be apparent that a unique amusement device is provided which has a wide range of uses. For example, the device may be built in any scale desired, and could, for example, be built in the form of a small hand-holdable cube which could simply be used as a changeable-configuration, decorative and/or play, object. Different materials may of course be used for forming the various tetrahedrons and hinges. As an example, materials and forms which have been tried and used successfully have included cardboard, leather, solid (i.e. non-hollow) forms, metal and other materials. The holes which are shown in device 10 form no part of the invention, and have been provided herein simply to show a way in which the proposed device may be used as a piece of play equipment.

Thus, while a preferred embodiment of the invention has been described and illustrated herein, it is appreciated that certain variations and modifications may be made without departing from the spirit of the invention.

It is claimed and desired to secure by letters patent:

1. A changeable-configuration geometric device comprising an equilateral tetrahedron having edges defining a plurality of equilateral triangular faces, four right tetrahedrons each having edges defining an equilateral triangular face of substantially the same size as each face in said equilateral tetrahedron, and means hinging each of said tetrahedrons to another tetrahedron, whereby said tetrahedrons may be swung relative to one another to produce an infinite number of overall configurations for said device, one of said configurations taking the form of an equilateral cube, with said one configuration resulting from each of said equilateral triangular faces in said right tetrahedrons being positioned in confronting, abutting congruent relationship with a different face in said equilateral tetrahedron.

2. The device of claim 1, wherein said hinging means includes a pair of hinges hinging together three of said right tetrahedrons into a subassembly, a third hinge hinging said subassembly to one edge in said equilateral tetrahedron, and a fourth hinge hinging the fourth right tetrahedron to another edge in said equilateral tetrahedron.

3. The device of claim 2, wherein said tetrahedrons have corners, and said hinging means is arranged whereby three corners in said three right tetrahedrons included in said subassembly are positioned adjacent one another and adjacent a corner in said equilateral tetrahedron, and said fourth right tetrahedron is arranged to have its equilateral triangular face close upon that face in said equilateral tetrahedron which is opposite said corner in the same.

4. The device of claim 2, wherein said one and other edges in said equilateral tetrahedron lie in a common plane.

5. The device of claim 4, wherein said tetrahedrons have corners, and said hinging means is arranged whereby three corners in said three right tetrahedrons included said subassembly are positioned adjacent one another and adjacent a corner in said equilateral tetrahedron, and said fourth right tetrahedron is arranged to have its equilateral triangular face close upon that face in said equilateral tetrahedron which is opposite said corner in the same.

6. The device of claim 5, wherein, with said device in a configuration whereby said equilateral triangular faces in the tetrahedrons making up said subassembly each occupy a plane common with the plane of a face in said equilateral tetrahedron, said fourth hinge extends along a line disposed at an angle oblique to said common plane.

7. The device of claim 5, wherein said hinges and tetrahedrons are arranged whereby the tetrehedrons may be swung to relative positions with said equilateral triangular faces in all four of said right tetrahedrons occupying said common plane of said one and other edges in said equilateral tetrehedron, and with all of the right tetrehedrons projecting in a common direction away from said common plane.

* * * * *